United States Patent [19]

Bernardi

[11] Patent Number: 4,524,601

[45] Date of Patent: Jun. 25, 1985

[54] AUTOMATIC APPARATUS FOR DOWNSETTING LEAD FRAME STRIPS

[76] Inventor: Carl E. Bernardi, 3048 Bayberry La., San Jose, Calif. 95148

[21] Appl. No.: 494,385

[22] Filed: May 13, 1983

[51] Int. Cl.[3] ..... B21D 43/00

[52] U.S. Cl. ..... 72/422; 72/424; 72/426; 72/428; 72/346

[58] Field of Search ..... 72/346, 379, 382, 412, 72/414, 422, 424, 426, 428, 465; 140/105; 29/827; 414/80, 121

[56] References Cited

U.S. PATENT DOCUMENTS

| | | | |
|---|---|---|---|
| 1,207,390 | 12/1916 | Frahm | 72/426 |
| 2,605,910 | 8/1952 | Kovatch | 414/80 |
| 2,627,890 | 2/1953 | Lloyd et al. | 72/424 |
| 2,728,468 | 12/1955 | Siempelkamp | 414/80 |
| 3,415,389 | 12/1968 | Smith | 414/80 |
| 4,260,310 | 4/1981 | Blake et al. | 414/121 |

FOREIGN PATENT DOCUMENTS

| | | | |
|---|---|---|---|
| 11345 | 1/1980 | Japan | 29/827 |
| 2083393 | 3/1982 | United Kingdom | 72/414 |

*Primary Examiner*—Lowell A. Larson
*Attorney, Agent, or Firm*—Allston L. Jones

[57] ABSTRACT

An automatic apparatus for downsetting lead frame strips includes a die set mounted in a punch press, two parallel guide rails for guiding the lead frame strips into the die set, a placing mechanism for placing lead frame strips onto the guide rails one at a time, a slide mechanism for advancing a lead frame strip along the guide rails and into the die set and for unloading a downset lead frame strip from the die set, a retractable stop and a slot in the die set for positioning the lead frame strip within the die set, and a stacker mechanism for neatly stacking downset lead frame strips on an output stack as they are unloaded from the die set.

37 Claims, 22 Drawing Figures

AUTOMATIC APPARATUS FOR DOWNSETTING LEAD FRAME STRIPS

BACKGROUND OF THE INVENTION

The present invention relates generally to apparatus for feeding objects into and unloading objects from a punch press, and relates more particularly to a high-speed automatic apparatus for downsetting die pads of lead frame strips.

Integrated circuits are commonly packaged inside a protective enclosure by mounting the chip containing the circuits on a lead frame located within the enclosure. The lead frame provides electrical connections between the chip and the outside of the enclosure. Typically, a lead frame is fabricated from a thin sheet of metal and has a die pad for mounting the chip and several electrical conductors surrounding and fanning out from the die pad area. Lead frames are commonly fabricated in strip form with several lead frames joined together. Some lead frames are fabricated in very long strips which are wound onto reels, others are fabricated in short strips containing approximately ten lead frames.

A lead frame is a flat piece of metal which is stamped or etched to remove portions thereof to define the die pad and the conductors. It is desireable to downset or lower the die pad by a distance equal to the thickness of the chip to be mounted to facilitate the subsequent process of wire bonding for electrically connecting the contact pads of the chip to the conductors of the lead frame. The process of wire bonding is performed with the aid of microscope viewers to allow an operator to guide a wire feed mechanism between the contact pads and the surrounding conductors. Downsetting enables the contact pads to be at the same elevation as the conductors, thereby eliminating refocusing of the microscope viewers and simplifing the movement of the wire feed mechanism.

The prior art technique for downsetting short strips of lead frames has been a manual operation where an operator sequentially places and positions a lead frame strip into a die set in a punch press, actuates the punch press, and removes the downset lead frame strip. One drawback to this manual technique is that productivity is low because of the high labor content and slow production rate. Potential for serious operator injuries is another drawback to this manual technique.

It would be desireable, therefore, to provide an apparatus for automatically loading lead frame strips into a die set, downsetting the lead frame strips, and unloading the downset lead frame strips. It would also be desireable for such an apparatus to be high-speed so as to minimize the unit cost of downsetting lead frame strips. Additionally, it would be advantageous for such an apparatus to be easily converted to accomodate a variety of lead frame strip sizes. The automatic apparatus of the present invention provides these advantages.

SUMMARY OF THE INVENTION

In accordance with the illustrated preferred embodiment, the present invention automatically downsets lead frame strips by sequentially loading and positioning a lead frame strip in a die set, closing the die set to downset the die pads of the lead frame strip, unloading the lead frame strip from the die set, and stacking the lead frame strip on a stack. The downset apparatus according to the present invention includes a die set with a fixed die and a moveable punch mounted in a punch press, two parallel guide rails for guiding the lead frame strips into the die set, a placing mechanism for placing lead frame strips onto the guide rails one at a time, a slide mechanism for advancing a lead frame strip along the guide rails and into the die set and for unloading a downset lead frame strip from the die set, a retractable stop and a slot in the die set for positioning the lead frame strip within the die set, and a stacker mechanism for neatly stacking downset lead frame strips on an output stack as they are unloaded from the die set.

In order to increase the throughput of the downset apparatus, several operations are performed simultaneously. When the ram of the punch press is actuated to downset a lead frame strip located within the die set, the placing mechanism simultaneously places another lead frame strip upon the guide rails, the stacker mechanism simultaneously releases another lead frame strip onto the top of the output stack, and a pin in the moveable punch simultaneously retracts the retractable stop in the die set. After the die set opens, the slide mechanism simultaneously unloads the downset lead frame strip from the die set and transfers it into the stacker mechanism, raises the retractable stop, and loads and positions the next lead frame strip in the die set. After the slide mechanism returns to its home position, the punch press ram is actuated once again to begin a new downsetting cycle.

The placing mechanism operates to transfer lead frame strips from an input stack to the guide rails, and includes an input stack positioning mechanism, a rail opening mechanism, and a vacuum pick-up mechanism. Lead frame strips to be downset are loaded by an operator onto an input stack portion of the input stack positioning mechanism. Locator pins surround the input stack to keep the lead frame strips in alignment. A photosensor senses the elevation of the uppermost lead frame strip on the input stack and directs a motor to raise the input stack when necessary to maintain a substantially constant stack height. The input stack is located directly beneath the guide rails with the length of the lead frame strips oriented parallel to the length of the guide rails.

Both the rail opening mechanism and the vacuum pick-up mechanism are coupled to the moveable punch of the die set. The rail opening mechanism spreads the guide rails as the die set is closed, creating a gap between the guide rails through which the vacuum pick-up mechanism lowers to grasp the uppermost lead frame strip on the input stack. When the die is subsequently opened, a vacuum platen of the vacuum pick-up mechanism lifts the uppermost lead frame strip from the stack and through the gap between the guide rails. As the moveable punch continues to raise, the rail opening mechanism closes the guide rails. As the guide rails close, rakes on the guide rails enter grooves in the vacuum platen to break the vacuum holding the lead frame strip and to place the lead frame strip on the guide rails.

The tasks of advancing a lead frame strip along the guide rails and into the die set and of unloading a downset lead frame strip from the die set are accomplished by a slide mechanism. When the die set has opened after downsetting a lead frame strip, a motor driven crank arm and lever are actuated by a one-shot clutch to move the slide mechanism from a home position to a forward position and then back to the home position. As the slide mechanism moves from the home position to the forward position, a pusher located between the guide rails pushes a lead frame strip into the fixed die. Simultaneously, an ejector pawl pushes the downset lead frame strip out of the fixed die. When the slide reaches the forward position, the ejector pawl is pivoted upward to provide clearance above the lead frame strip in the fixed die during the slide movement back to the home position. When the slide returns to the home position, the ejector pawl is pivoted downward in preparation for the next load/unload cycle.

Positioning of the lead frame strip within the die set is accomplished by a retractable stop and a slot in the die set. When the lead frame strip is loaded into the fixed die, the pusher bottoms out at the end of the slot when the lead frame strip is sufficiently advanced into the fixed die. At this time, the retractable, upwardly extended, stop prevents the lead frame strip from advancing too far. The distance between the end of the slot and the stop is substantially equal to the length of the lead frame strip. Guide rails within the fixed die act to laterally position the lead frame strip. When the die set closes to downset the lead frame strip, locator pins in the moveable punch enter registration holes in the lead frame strip to provide accurate alignment with the punch.

Since the retractable stop blocks the path of the lead frame strip during loading, it must be retracted to permit unloading of the downset lead frame strip from the die set. This is accomplished by a pin in the moveable punch which retracts the stop when the die set closes. A spring-loaded actuator bar latches the stop in the lowered position. To extend the stop upward after the downset lead frame strip has been unloaded and before the next lead frame strip is loaded, a cam on the slide mechanism depresses the actuator bar which in turn permits the spring-loaded stop to raise.

As the downset lead frame strips are unloaded from the die set, they are neatly stacked in an output stack by the stacker mechanism in a two step operation. In the first step of the stacking operation, a downset lead frame strip is unloaded from the die set by the ejector pawl and slides between two side plates and onto two support rails. The support rails are tilted downward so that the lead frame strip slides forward until it comes to rest against a backing plate. A stacker actuator mechanism is coupled to the moveable punch and is operable for pivoting the support rails. When the die set closes, the support rails expand, allowing the lead frame strip to drop on the top of the output stack. The stacker mechanism includes a pivoting base which pivots to facilitate the unloading of the output stack and to facilitate changing the die set to accomodate different sized lead frame strips.

DESCRIPTION OF THE PREFERRED EMBODIMENT

Figure 1A:
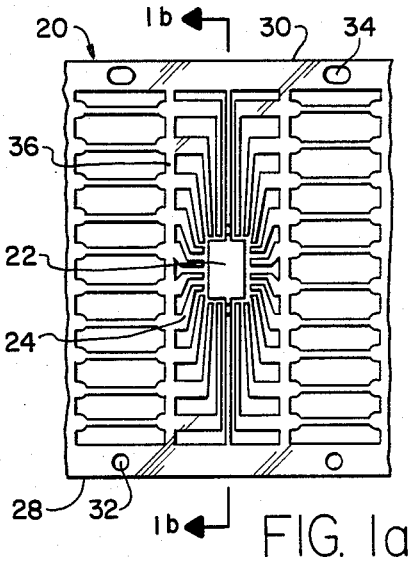
FIGS. 1*a* and 1*b* are, respectively, a plane view and a section view of a portion of a lead frame strip having a downset die pad.
Figure 1B:
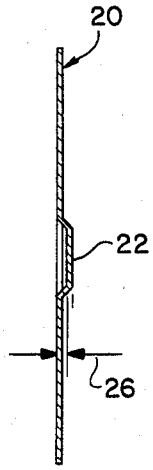

In reference to FIGS. 1*a* and 1*b*, there is shown a portion of a lead frame strip 20 having a downset die pad 22 Die pad 22 is surrounded by conductors 24 which will provide electrical connections for an integrated circuit die to be subsequently mounted upon the die pad. FIG. 1*b* illustrates the extent of the downset as dimension 26, which substantially equals the thickness of the die. The lead frame strip is typically fabricated by stamping or etching a thin sheet of metal. Several individual lead frames are fabricated on a single strip and are interconnected by two rails 28 and 30 which extend the entire length of the strip 20. Registration holes 32 and slots 34 provide means for positioning the lead frame strip during subsequent die packaging and wiring operations. The conductors are interconnected by tabs 36 to provide dimensional stability to the conductors during the subsequent die packaging and wiring operations. After the integrated circuit die has been packaged and wired, the tabs and rails are cut away to electrically isolate the conductors.

Figure 2:
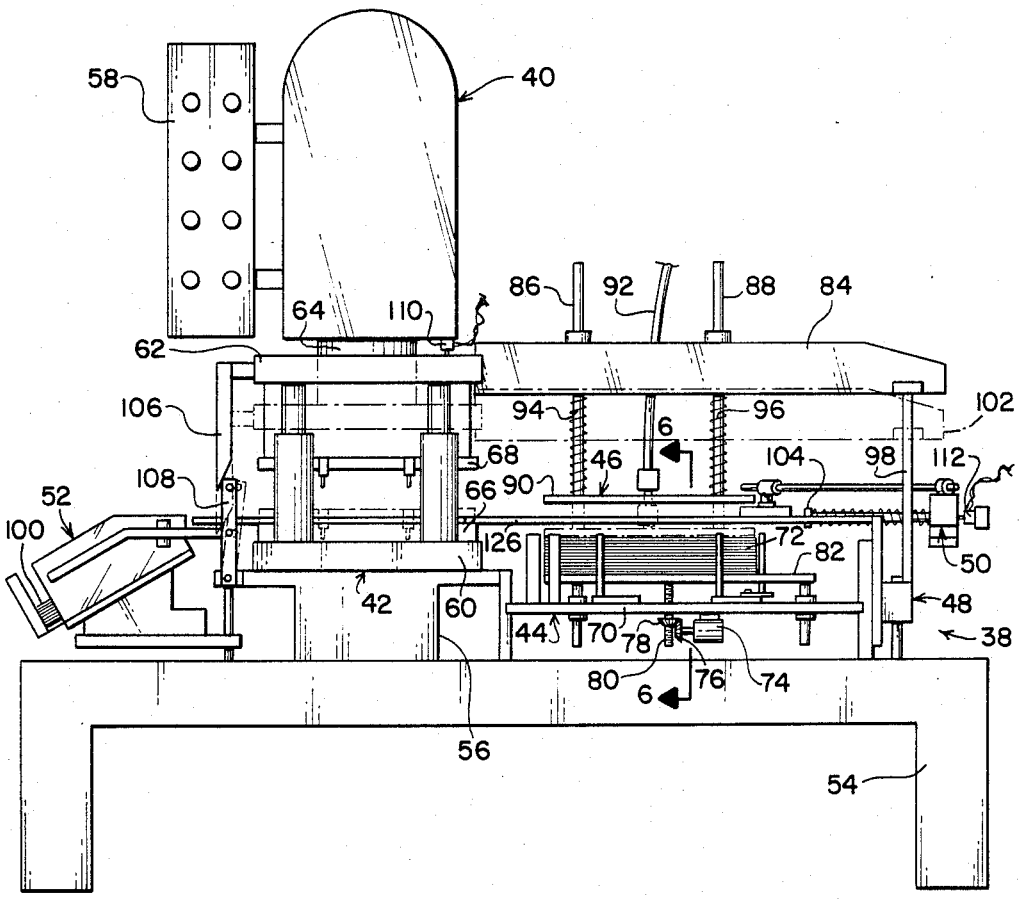
FIG. 2 is an overall front elevational view of an automatic downset apparatus according to the present invention.

In FIG. 2, an automatic downset apparatus is illustrated generally as 38. Automatic downset apparatus 38 includes a punch press 40 with a die set 42 mounted therein for downsetting a lead frame strip 20, an input stack positioning mechanism 44 for holding and positioning a stack of lead frame strips to be downset, a vacuum pick-up mechanism 46 for individually placing lead frame strips upon guide rails, a rail opening mechanism 48 for spreading the guide rails to permit the vacuum pick-up mechanism to pick up a lead frame strip, a slide mechanism 50 for advancing a lead frame strip along the guide rails (shown at 126 and 128 in FIG. 3) and into the die set and for unloading a downset lead frame strip from the die set, and a stacker mechanism 52 for stacking downset lead frame strips on an output stack. Die set 42 will be described below in further detail with reference to FIGS. 8, 9, 10, 11, and 12, input stack positioning mechanism 44 will be described below with reference to FIGS. 6 and 7, vacuum pick-up mechanism 46 will be described below with reference to FIGS. 2, 4, and 6, rail opening mechanism 48 will be described below with reference to FIGS. 4 and 5, slide mechanism 50 will be described below with reference to FIGS. 3, 4, 10, 11, and 12, and stacker mechanism 52 will be described below with reference to FIGS. 13, 14, 15, and 16.

A table 54 (FIG. 2) provides a support base for punch press 40 and the mechanisms of the automatic downset apparatus 38. Punch press 40 includes a bolster 56 that is secured to the table and a control box 58 which houses control switches and wiring. Die set 42 is mounted within the punch press and includes a die shoe 60 that is fixedly mounted to bolster 56 and a punch holder 62 that is mounted to and moveable with the ram 64 of the punch press. A die 66 and a punch 68 are respectively affixed to the die shoe and the punch holder. Die 66 and punch 68 act to downset a lead frame strip positioned therein when the punch press closes the die set.

The input stack positioning mechanism 44 is mounted to a shelf 70 that slides out to permit an operator to load lead frame strips to be downset onto an input stack 72. During the operation of the automatic downset apparatus 38, a motor 74 drives gears 76 and 78 to raise a shaft 80 and an input stack plate 82 to keep the uppermost lead frame strip of the input stack at a uniform height. See discussion below in relation to FIGS. 6 and 7 for further details concerning the input stack positioning mechanism.

The vacuum pick-up mechanism 46 moves up and down with the movement of the ram 64 and acts to place the uppermost lead frame strip of the input stack 72 onto the guide rails leading into the die 66. A support bar 84 is affixed to and moveable with the punch holder 62 of the die set. Support bar 84 extends horizontally from the punch holder and provides a mounting point for two platen shafts 86 and 88. Platen shafts 86 and 88 are disposed vertically and are slideably mounted to the support bar. A vacuum platen 90 is affixed to the lower ends of the platen shafts and is positioned directly above the input stack. A vacuum hose 92 connects the vacuum platen to a source of vacuum (not shown). Compression springs 94 and 96 are installed on the platen shafts between the vacuum platen and the support bar. The slideable mountings of the platen shafts permit the vacuum platen to contact the input stack and stop while the ram and the support bar continue to move downward. The springs apply a force to the input stack through the vacuum platen to insure good contact and reliable pick-up. The support bar also provides a mounting point for a connecting bar 98 which actuates the rail opening mechanism 48 during the movement of the ram.

In operation, the automatic downset apparatus 38 transfers lead frame strips from the input stack 72 into the die set, downsets the die pads of the lead frame strips, and stacks the downset lead frame strips into an output stack 100. To begin operation, an operator loads a stack of lead frame strips to be downset onto the input stack 72, then slides the shelf 70 back into position. The operator then pushes a start button on the control box 58 to begin the automatic downsetting operation. First, the ram 64 lowers to close the die set and the vacuum platen 90 contacts the uppermost lead frame strip on the input stack. This position is shown in FIG. 2 in dotted lines at 102. Next, the ram raises to open the die set and the vacuum platen lifts the uppermost lead frame strip off of the input stack and onto the guide rails. Next, a pusher 104 of the slide mechanism 50 pushes the lead frame strip along the guide rails and into the die 66, where it is positioned by means described below. Next, the slide mechanism returns to the home position shown in FIG. 2. Next, the ram lowers and raises to close and open the die set and to downset the lead frame strip positioned therein. Simultaneously, the vacuum pick-up mechanism 46 places a second lead frame strip onto the guide rails. Next, the slide mechanism pushes the downset lead frame strip into the upper level of the stacker mechanism 52 and pushes the second lead frame strip into the die set. Then the slide mechanism returns to the home position. Next, the ram closes and opens the die again to downset the second lead frame strip. Simultaneously, a cam bar 106 affixed to the punch holder 62 and a stacker actuation lever 108 pivotably mounted to the bolster 56 actuate the stacker mechanism to allow the first downset lead frame strip to fall onto the top of the output stack. Also simultaneously, the vacuum pick-up mechanism places a third lead frame strip onto the guide rails.

From this point onward, each cycle of the punch press 40 causes three actions: the vacuum pick-up mechanism 46 places a lead strip 20 onto the guide rails, the die set 42 downsets another lead frame strip, and the stacker mechanism 52 drops a downset lead frame strip onto the top of the output stack 100. Additionally, each cycle of the slide mechanism 50 causes two actions: it loads a lead frame strip into the die set, and it unloads a downset lead frame strip from the die set and into the stacker mechanism. The punch press cycle and the slider cycle occur alternately and continue until all of the lead frame strips have been downset. A switch 110 mounted to the punch press 40 indicates when the punch press cycle has been completed and enables the start of the slider cycle. A switch 112 mounted to the slide mechanism indicates when the slider cycle is completed and enables the start of the punch press cycle.

Figure 3:
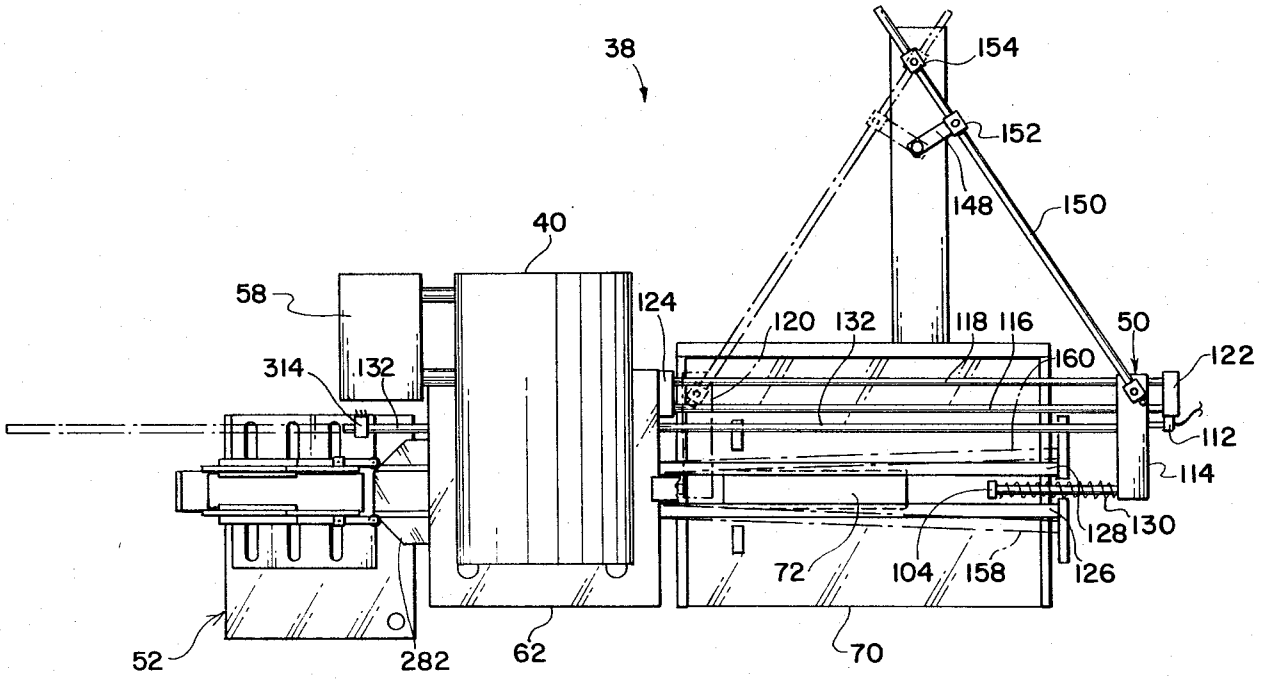
FIG. 3 is an overall plan top view of the automatic downset apparatus of FIG. 2.
Figure 4:
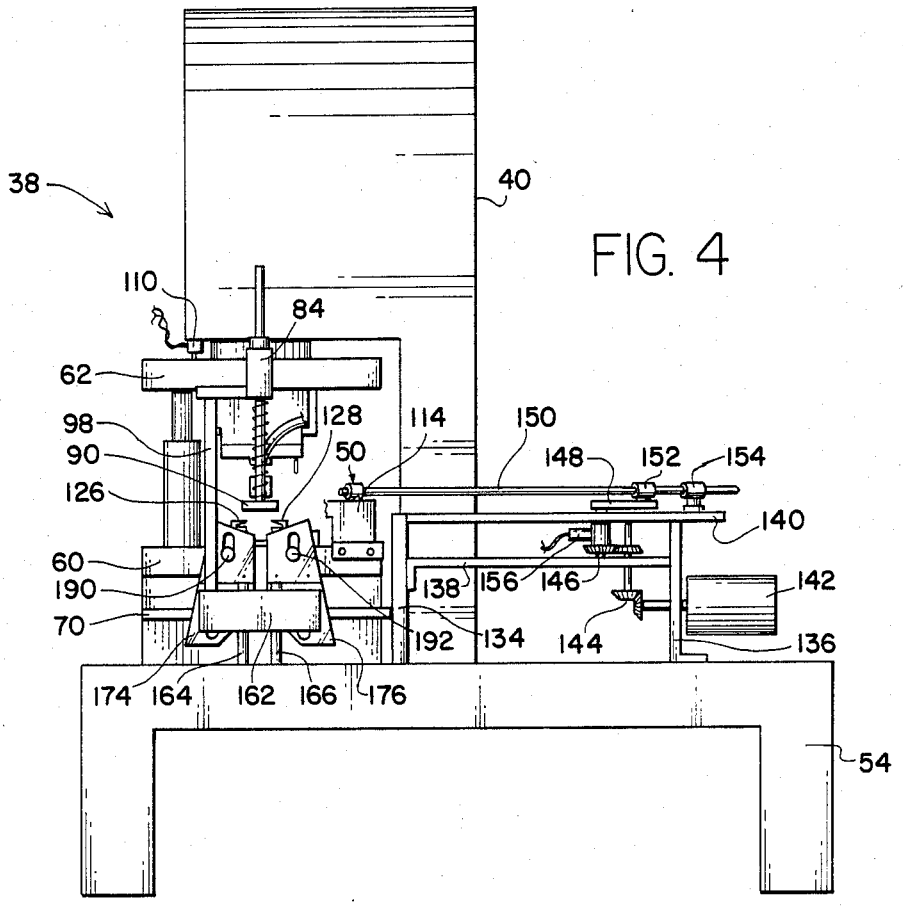
FIG. 4 is a right side elevational view of the automatic downset apparatus of FIG. 2.

The operation of the slide mechanism 50 is shown in greater detail in FIGS. 3 and 4. In FIG. 3, slide mechanism 50 is shown as including a slide 114 which is linearly guided by two slide shafts 116 and 118 and moveable between the home position shown in solid lines and a forward position shown in dashed lines at 120. Slide shafts 116 and 118 are fixedly mounted to stationary clamps 122 and 124 at each end thereof and are oriented to be parallel to the guide rails 126 and 128. Pusher 104 is slideably mounted to and moveable with slide 114. Pusher 104 is positioned between guide rails 126 and 128 and acts to push a lead frame strip 20 along the guide rails and into the die set during a slider cycle. A compression spring 130 on the shaft of the pusher biases the pusher away from the slide and compresses when the pusher bottoms out in the die 66. An ejector bar 132 is affixed to and moveable with the slide. The ejector bar is utilized to unload a downset frame strip from the die set and will be described in greater detail below in reference to FIG. 10.

Propulsion for the slide 114 is provided by a motor driven reciprocating crank mechanism shown in FIGS. 3 and 4. The crank mechanism is mounted to a support structure formed by plates 134, 136, 138, and 140 which are bolted together and affixed to the table 54. A motor 142 drives a gear train 144 which in turn drives a one-shot clutch 146. A crank arm 148 is mounted on and driven by the output shaft of clutch 146. A crank lever 150 is pivotably mounted to the slide and slideably coupled to the crank arm by a pivot block 152. Crank lever 150 is also slideably coupled to plate 140 by another pivot block 154.

To begin the slider cycle, a solenoid 156 actuates the one-shot clutch 146 which then rotates the crank arm for one revolution. As the crank arm 148 rotates at constant angular velocity, the crank lever 150 pivots about pivot block 154 and causes the slide 114 to move along the slide shafts 116 and 118. The slide accelerates from rest as it moves from the home position and reaches a peak velocity when midway to the forward position 120. The slide then decelerates until it comes to rest at the forward position. As the crank arm continues to rotate, the slide moves back to the home position. When the slide reaches the home position, it actuates switch 112 and stops until after the next ram cycle is complete. Since the crank arm is located between pivot block 154 and slide 114, the return stroke of the slider is faster than the feed stroke, thereby saving time and increasing productivity.

Figure 5:
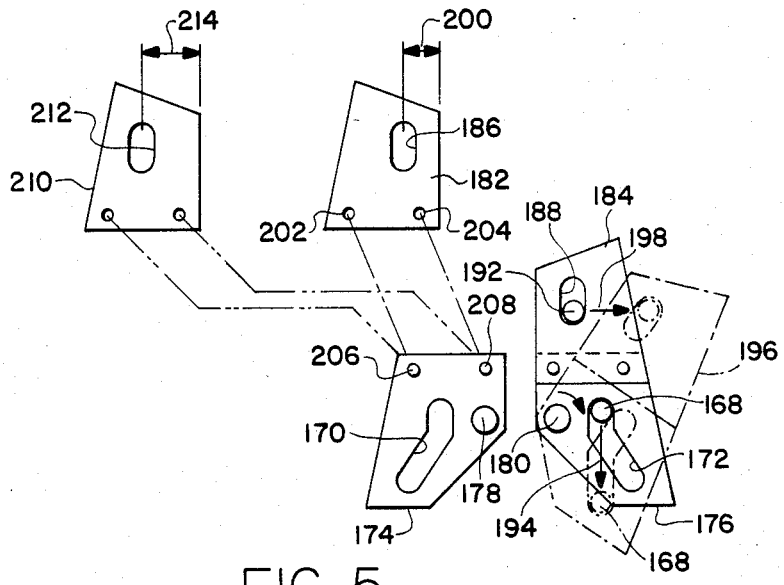
FIG. 5 is a right side elevational view of rail cams utilized in a rail opening mechanism of the present invention and illustrates cam interchangeability and operation.

The operation of the rail opening mechanism 48 is shown in FIGS. 4 and 5. The function of the rail opening mechanism is to spread guide rails 126 and 128 apart during the punch press cycle to provide clearance between the guide rails for the vacuum platen 90 to access the input stack 72 of lead frame strips. Guide rails 126 and 128 are pivotably mounted at one end thereof to the die 66 and are spread apart by the rail opening mechanism to the positions shown in dashed lines in FIG. 3 at 158 and 160 to uncover the input stack. A further function of the rail opening mechanism is to break the vacuum seal between the vacuum platen and the lead frame strip to place the lead frame strip on the guide rails during the upstroke of the punch press cycle.

The rail opening mechanism 48 is actuated by connecting bar 98 which is coupled to the movement of the ram 64 by the support bar 84. An actuator body 162 is affixed to and moveable with the lower end of connecting bar 98. Actuator body 162 is guided in its vertical travel by two guide rods 164 and 166 that are affixed to the table 54. Pins 168 in the actuator body couple the actuator body to slots 170 and 172 in two cam base plates 174 and 176. Cam base plates 174 and 176 pivot about horizontal pins 178 and 180 that are fixedly coupled to the table. Rail cam plates 182 and 184 are removeably attached to the upper portion of the cam base plates and act to couple the cam base plates to the guide rails 126 and 128. The rail cam plates have slots 186 and 188 which act to spread the guide rails when the cam base plates are rotated by the actuator body. Pins 190 and 192 are affixed to the ends of the guide rails and protrude into slots 186 and 188. The guide rails are constrained so as to be free to move only in a lateral direction.

In operation, the rail opening mechanism 48 opens the guide rails 126 and 128 during the downstroke of the ram 64 and closes the guide rails during the upstroke. On the downstroke, the actuator body 162 and pin 168 travel downward. The downward motion (arrow 194) of pin 168 causes cam base plate 176 to rotate clockwise about pin 180 to the position shown in dashed lines in FIG. 5 at 196. Simultaneously, cam base plate 174 rotates counterclockwise by an equivalent amount. Rail cam plate 184 rotates with cam base plate 174, causing pin 192 to move laterally as shown by arrow 198 and causing guide rail 128 to move to position 160 (FIG. 3).

The automatic downset apparatus 38 according to the present invention is adaptable to permit it to downset lead frame strips of various sizes. One advantage of the present invention is that the setup process to accomodate a different lead frame strip size involves substitution of parts of the various mechanisms and does not require adjustments. One part substitution to accomodate a different width of lead frame strip is shown in FIG. 5. The spacing between the guide rails 126 and 128 must be equal to the width of the lead frame strip plus a small clearance. The spacing between the guide rails at the die end is controlled by the positioning of the rail pivot points in the die 66. The spacing between the guide rails at the opposite end is controlled by the positions of slots 186 and 188 in rail cam plates 182 and 184. Dimension 200 in rail cam plate 182 controls the separation of the guide rails. The position of rail cam plate 182 is keyed to the cam base plate 174 by two locating holes 202 and 204 which pick up dowel pins 206 and 208 in the cam base plate. To change the guide rail spacing to accomodate a different width lead frame strip, rail cam plate 182 is removed and replaced by another rail cam plate 210, with a slot 212 positioned at a different dimension 214. On the right side, rail cam plate 184 is also replaced with another rail cam plate also having a slot at dimension 214.

Figure 6C:
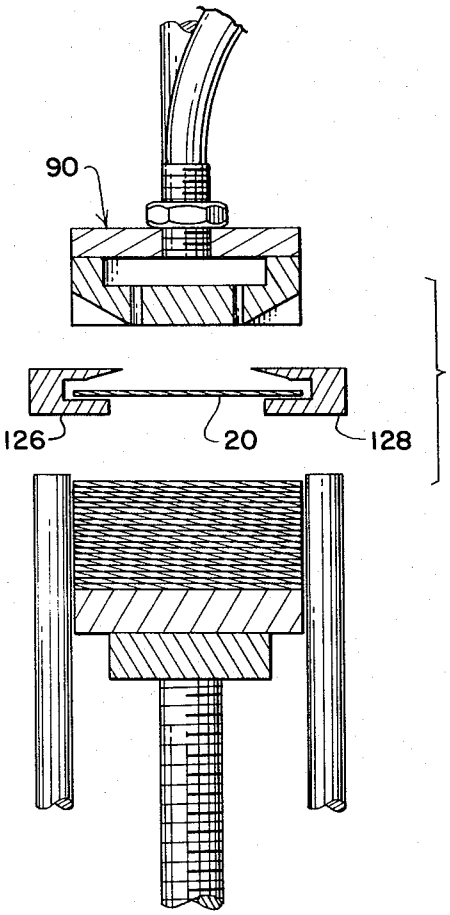
FIGS. 6*a*, 6*b*, and 6*c* are sectional views of portions of an input stack positioning mechanism and a vacuum pick-up mechanism and illustrate the relative positions of same at three consecutive points in time.
Figure 6B:
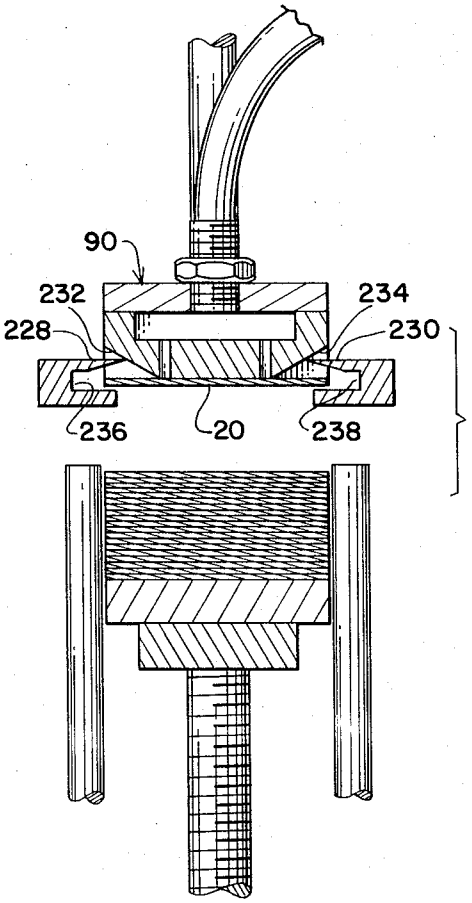
Figure 6A:
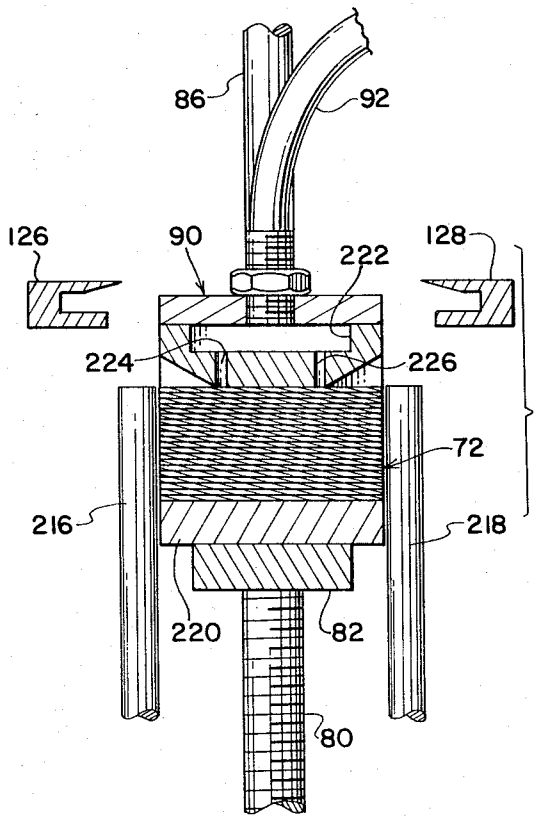

FIG. 6 illustrates the second function of the rail opening mechanism: breaking the vacuum seal between the vacuum platen 90 and the lead frame strip to place the lead frame strip on the guide rails 126 and 128 during the upward portion of the ram cycle. FIG. 6*a* shows the vacuum platen in contact with the uppermost lead frame strip on the input stack 72. Locator pins 216 and 218 of the input stack positioning mechanism 44 surround the input stack to keep the lead frame strips in vertical alignment. Shaft 80 raises the input stack plate 82, a stack support plate 220, and the input stack to the proper height. The vacuum platen has an internal cavity 222 that distributes the vacuum from the vacuum hose 92 to ports 224 and 226 dispersed throughout the undersurface off the vacuum platen. The ports are located adjacent to solid portions of the lead frame strips to insure a proper seal therewith.

FIG. 6*b* shows the vacuum platen 90 with the uppermost lead frame strip on the way up from the top of the input stack 72 during the upstroke of the punch press ram cycle. As the vacuum platen is raised, the guide rails 126 and 128 begin to move together according to the shape of the slots 170 and 172 in the cam base plates 174 and 176. As the guide rails move together, rakes 228 and 230 enter grooves 232 and 234, respectively, in the vacuum platen. As the vacuum platen continues to rise and the guide rails continue to move together, the rakes restrain the vertical movement of the lead frame strip and separate it from the vacuum platen. The rakes and grooves are shaped and the closure of the guide rails is timed such that the lead frame strip is captured in channels 236 and 238 of the guide rails as the guide rails move together.

In FIG. 6*c*, the vacuum platen has completed its upward travel and the guide rails are back to their parallel position. The lead frame strip is now ready to be pushed into the die set by the slide mechanism. A vacuum switch (not shown) is coupled to the movement of the ram and applies vacuum to the vacuum platen as it approaches the input stack. The vacuum switch also shuts the vacuum off to the vacuum platen as it reaches the level shown in FIG. 6*b*. Since a residual vacuum may exist within the chamber 222 of the vacuum platen, the positive stripping action of the rakes is provided to insure the separation of the lead frame strip from the vaccuum platen.

When modifying the automatic downset apparatus 38 to change over to downset different lead frame strips, the vacuum platen is an additional part that must be exchanged. The reason for this is that different lead frame strips are usually shaped differently and thus require a different pattern of ports 224 and 226 in the vacuum platen.

Figure 7:
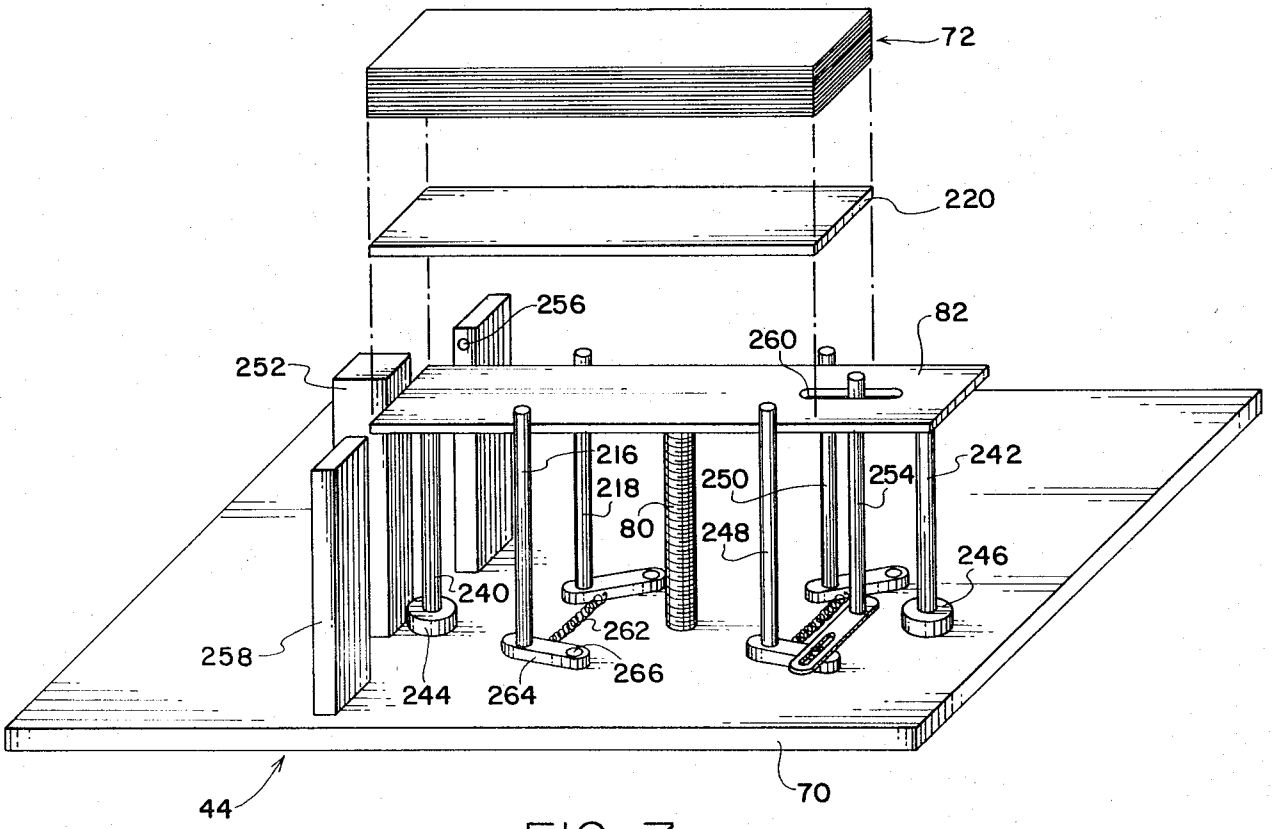
FIG. 7 is an overall perspective view of the input stack positioning mechanism of the present invention.

FIG. 7 illustrates the components of the input stack positioning mechanism 44. The input stack plate 82 is guided in vertical movement by rods 240 and 242 which are slideably coupled to the shelf 70 by linear bushings 244 and 246. The stack support plate 220 is removeably affixed to the top of the input stack plate. The length and width of the stack support plate is just slightly larger than the length and width of its corresponding lead frame strips. Lead frame strips form an input stack 72 on top of the stack support plate. Locator pins 216, 218, 248, and 250 act to laterally position the input stack. A fixed locator block 252 and an adjustable locator pin 254 act to longitudinally position the input stack.

When the automatic downset apparatus 38 is in operation, the top of the input stack 72 is held at a present height. A photosensor 256 senses the amount of light from an illumination source 258 that is partially blocked by the input stack. After several lead frame strips have been loaded onto the guide rails by the vacuum pick-up mechanism 46, the photosensor directs the motor 74 (FIG. 2) to raise the input stack plate 82. A switch (not shown) senses when the shelf 70 has been pulled out for loading of more lead frame strips onto the input stack. When this condition is detected, the motor lowers the input stack plate to make room for more lead frame strips. When the shelf is then pushed back in, the motor raises the input stack plate until the photosensor shuts it off.

When modifying the automatic downset apparatus 38 to change over to downset different lead frame strips, the stack support plate 220 must be exchanged if the new lead frame strip is a different size. After the new stack support plate is fastened to the input stack plate 82, the adjustable locator pin 254 is moved along slot 260 until it butts against the stack support plate. The lateral locator pins 216, 218, 248, and 250 are biased by springs 262 and rotate in their bases 264 about pivots 266 until they contact the stack support plate.

Figure 8:
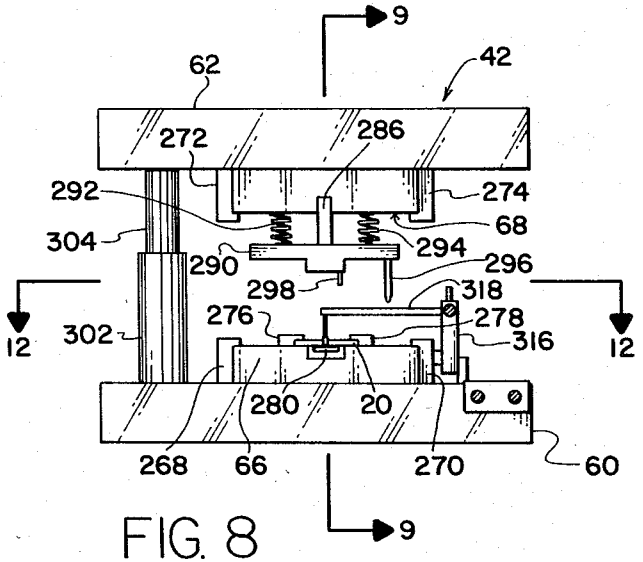
FIG. 8 is right side elevational view of a die set utilized in the present invention for downsetting lead frame strips.
Figure 9:
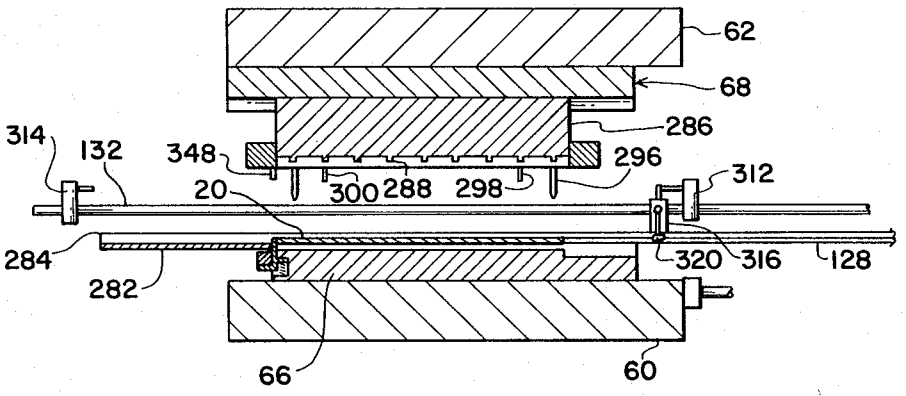
FIG. 9 is a sectional view of the die set of FIG. 8 and is viewed along the section line marked (FIG. 9) in FIG. 8.

The construction details of the die set 42 are illustrated in FIGS. 8 and 9. The die shoe 60 and the punch holder 62 are constructed so as to readily permit the die 66 and punch 68 to be removed and replaced to change over to down set lead frame strips of a different size. The die is held laterally in the die shoe by two rails 268 and 270 and is locked in place by a key (not shown). Similarly, the punch is held laterally in the punch holder by two rails 272 and 274 and is locked in place by another key (not shown). Removal of the keys permits the die and punch to be removed by sliding them on the rails. The stacker mechanism 52 pivots out of the way to facilitate die and punch removal. Removal and substitution of the die and punch is required when changing over to accomodate a different lead frame strip because each die and punch pair is fabricated specifically for a single type of lead frame strip. Variations in size and distribution and location of die pads between lead frame strip types are accomodated during the fabrication of the dies and punches.

The die 66 and punch 68 are constructed according to conventional design. The die 66 includes two guide rails 276 and 278 to laterally position the lead frame strip 20 within the die. Guide rails 276 and 278 are extensions of guide rails 126 and 128. A channel 280 beneath the lead frame strip provides clearance for the die pads 22 when downset. A die extension plate 282 extends the die surface and provides and edge 284 over which the downset lead frame strips exit the die. The punch includes a fixed punch plate 286 with protrusions 288 on the bottom surface thereof for downsetting the die pads. The punch also includes a stripper plate 290 that is biased downward by springs 292 and 294. Die alignment pins 296 in the stripper plate act to align the stripper with the die. Lead frame alignment pins 298 and 300 are tapered pins that are disposed on the stripper plate. Pins 298 and 300 enter the registration holes 32 of the lead frame strip to align the lead frame strip with protrusions 288 for accurate downsetting. Bushing 302 is affixed to the die shoe 60 and shaft 304 is affixed to the punch holder 62 and mates with bushing 302. The bushing and shaft provide consistent and accurate alignment of the punch holder with respect to the die shoe.

Figure 10A:
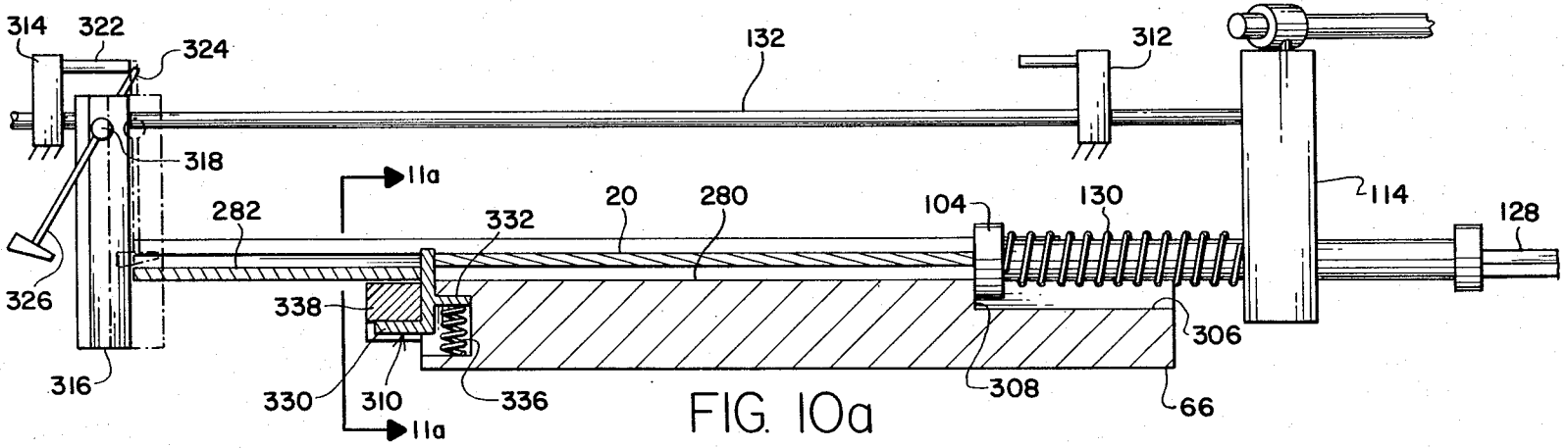
FIGS. 10*a* and 10*b* are front elevation sectional views of a fixed die portion of the die set illustrating the function of a retractable stop and a slot for positioning a lead frame strip within the fixed die and is viewed along the section line marked (FIG. 10) in FIG. 12.
Figure 10B:
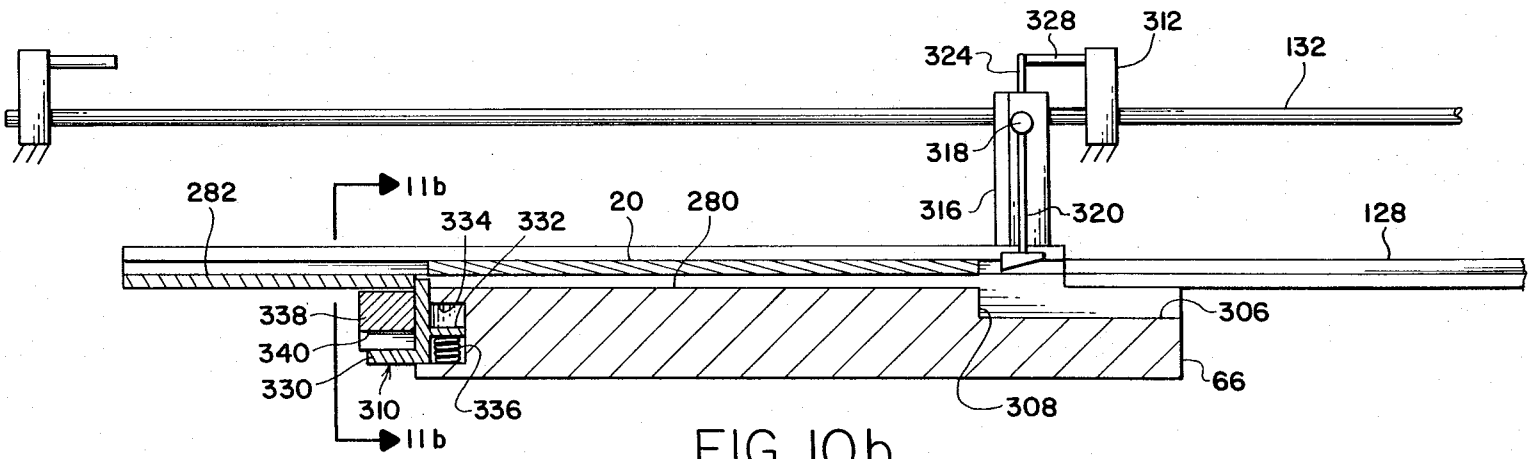

A novel method of positioning an object such as a lead frame strip 20 within die set 42 is illustrated in FIGS. 10*a* and 10*b*. A slot 306 is formed in die 66 between the guide rails 276 and 278. When the slide mechanism 50 moves from the home position toward the forward position, the pusher 104 on the slide 114 pushes the lead frame strip into the die 66 until it bottoms out at the end 308 of the slot 306. Any forward movement of the slide subsequent to the pusher bottoming out is absorbed by compression of spring 130. Forward movement of the lead frame strip after the pusher bottoms out is prevented by a retractable stop 310. The distance from the end of the slot to the retractable stop is just slightly greater than the length of the lead frame strip. Final positioning of the lead frame strip is performed by the tapered alignment pins 298 and 300 in the stripper.

Such a method of positioning an object is advantageous because adjustment of the slider mechanism is not required after change over to downset a differently sized lead frame strip. The compliance in the spring loaded pusher 104 compensates for any variation in the position of the end 308 of slot 306. Since the locations of the retractable stop 310 and the slot are built into the die 66, the lead frame strip can always be centered within the punch press without adjustment.

The slide mechanism 50 acts to unload a downset lead frame strip from the die 66 while simultaneously loading another frame strip into the die. Ejector bar 132 is affixed to and travels with the slide 114. Two bushings 312 and 314 are fixedly mounted and act to support and guide the ejector bar during its movement. An ejector arm base 316 is affixed to and travels with the ejector bar. Extending horizontally inwardly into the die from the ejector arm base is an ejector arm 318. Ejector arm 318 positions an ejector pawl 320 directly between the guide rails 276 and 278 of the die. During the forward motion of the slide mechanism from the home position to the forward position, the ejector pawl pushes the downset lead frame strip out of the die. When the slide mechanism reaches the forward position, a pin 322 affixed to bushing 314 contacts an ejector arm lever 324 which rotates the ejector arm and ejector pawl to an elevated position shown at 326 in FIG. 10*a*. With the ejector pawl at the elevated position 326, the pawl clears the lead frame strip in the die during the return of the slide mechanism to the home position. When the slide mechanism reaches the home position, the ejector lever 324 contacts a pin 328 affixed to bushing 312, whereupon the ejector arm and ejector pawl rotate back to the vertical position, ready for the next unload cycle.

The retractable stop 310 must be lowered below the level of the lead frame strip before it can be unloaded from the die 66. FIGS. 10 and 11 illustrate the operation of the retractable stop. Stop 310 is L-shaped with the horizontal leg 330 of the L extending outwardly of the die. Stop 310 has a pin 332 that extends inwardly into a cavity 334 in the die. Within the cavity is a compression spring 336 that biases the stop in the upward direction. The position of a stop actuator bar 338 determines the position of the stop. When the stop actuator bar is retracted, the leg 330 of the stop 310 lines up with and fits into a notch 340 in the bar which permits spring 336 to raise the stop. When the stop actuator bar is extended, however, leg 330 and notch 340 do not line up, holding stop 310 in its retracted position. Stop 310 is shown is the raised position is FIG. 10*a* and in the retracted position in FIG. 10*b*.

Figure 11A:
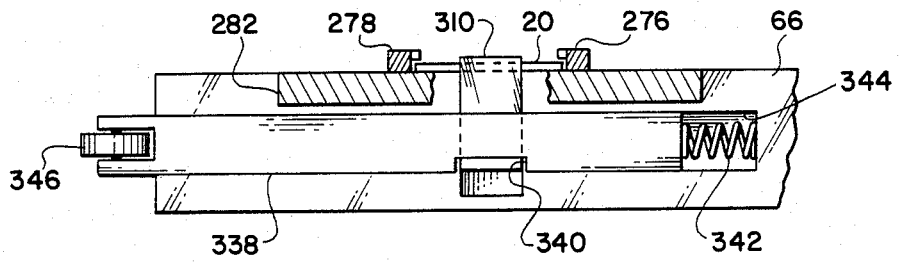
FIGS. 11*a*, 11*b*, and 11*c* are left side elevation sectional views of the die set illustrating the positions of the retractable stop at three consecutive points in time, and are viewed along the section lines marked (FIG. 11*a*) and (FIG. 11*b*) in FIGS. 10*a* and 10*b*.
Figure 11B:
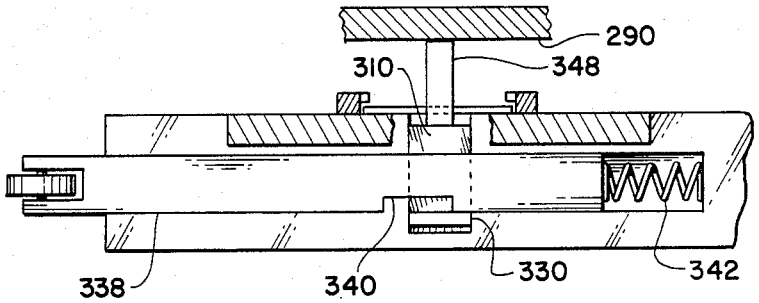
Figure 11C:
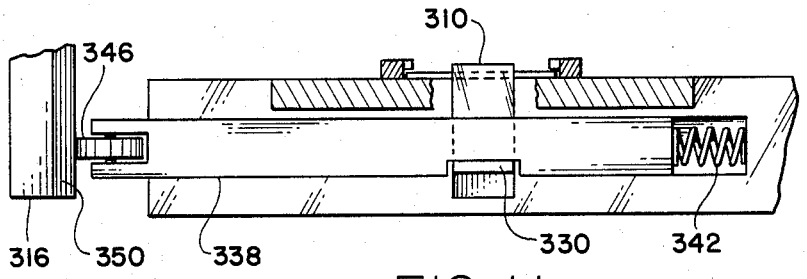

FIGS. 11*a*, 11*b*, and 11*c* shown more clearly the operation of the stop actuator bar 338. The stop actuator bar is biased to the left as viewed in FIG. 11 by a compression spring 342 positioned within a cavity 344 and acting on the end of bar 338. A roller 346 with a vertical axis is rotatably mounted to the other end of bar 338. In FIG. 11*a*, bar 338 is retracted and spring 342 is compressed. The stop 310 is in the raised position since leg 330 fits into notch 340 in bar 338.

During the downstroke of the punch press cycle, the stop 310 is forced downward by a reset pin 348 in the punch 68. Leg 330 of the stop moves out of notch 340, allowing spring 342 to extend the stop actuator bar 338. The stop is locked in this retracted position by the position of bar 338, as shown in FIG. 11*b*. Unloading of the downset lead frame strip can now proceed.

In order to position the next incoming lead frame strip, the stop 310 must be reset to the raised position after the downset lead frame strip is unloaded. To accomplish this, a cam surface 350 on the ejector arm base 316 contacts roller 346 and retracts the stop actuator bar 338. As bar 338 retracts, notch 340 lines up with leg 330, allowing the spring 336 to raise the stop, as shown in FIG. 11*c*.

Figure 12:
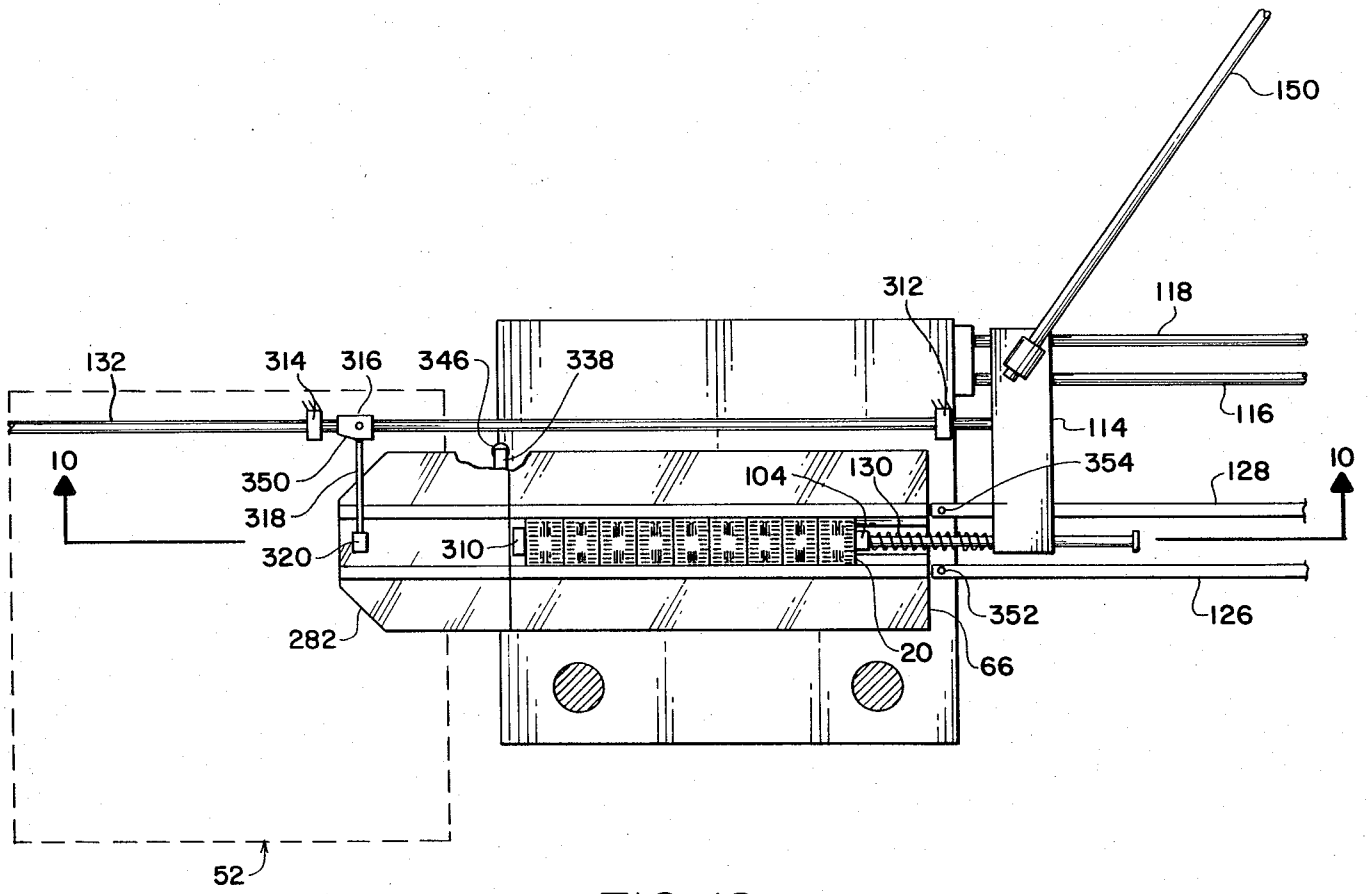
FIG. 12 is a sectional plan view of the die set and a portion of a slide mechanism and is viewed along the section line marked (FIG. 12) in FIG. 8.

In FIG. 12, the cam surface 350 is more clearly illustrated. As the ejector arm base 316 moves from bushing 312 toward bushing 314, the ejector pawl 320 unloads a downset lead frame strip from the die 66. As the ejector pawl passes the stop 310, the cam surface 350 contacts roller 346 and retracts the stop actuator bar 338, which in turn allows the stop to raise. Also shown in FIG. 12 are pivots 352 and 354 that pivotably attach the guide rails 126 and 128 to the die.

The construction and operation of the stacker mechanism 52 is shown in FIGS. 13, 14, 15, and 16. In reference particularly to FIG. 13, the stacker mechanism generally includes a stacker 356 and a stacker actuator 358. Stacker 356 has a horizontally disposed base plate 360 that is pivotally mounted to table 54 at pivot 362. A vertical plate 364 joins an inclined receiver plate 366 to the base plate. Receiver plate 366 has lateral slots 368 in the surface thereof. A spacer plate 370 is secured to the center of the receiver plate and in line with the guide rails of the die. Two stacker side plates 372 and 374 flank the spacer plate and are secured to the receiver plate by fastners fastened through the lateral slots 368 and into the bottom edges of the stacker side plates. The stacker side plates are oriented vertically and are spaced apart by a dimension slightly larger than the width of the lead frame strips. Two support rails 376 and 378 are pivotably mounted to blocks 380 and 382 that project outwardly from the face of the stacker side plates. One end of each support rail projects horizontally toward the die and has a vertical axis roller 384 and 386 at the end thereof. The other end of each support rail extends in the opposite direction and is inclined downward. The inclined portion 388 and 390 of the support rails protrudes into the space between the stacker side plates. A backing plate 392 is affixed to the spacer plate and closes off the lower portion of the space between the stacker side plates.

Figure 13:
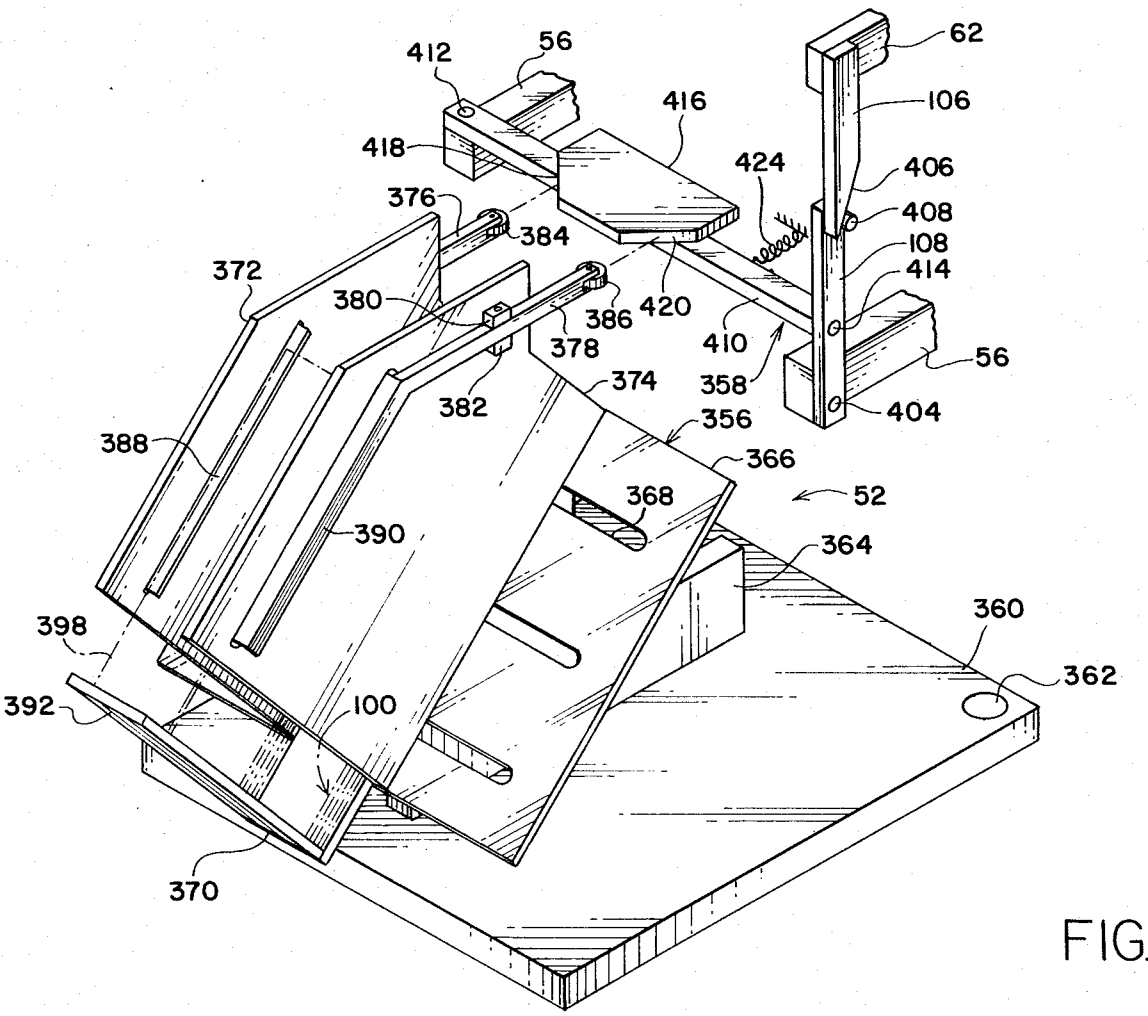
FIG. 13 is a perspective view of a stacker mechanism for stacking downset lead frame strips as they are unloaded from the die set.
Figure 14:
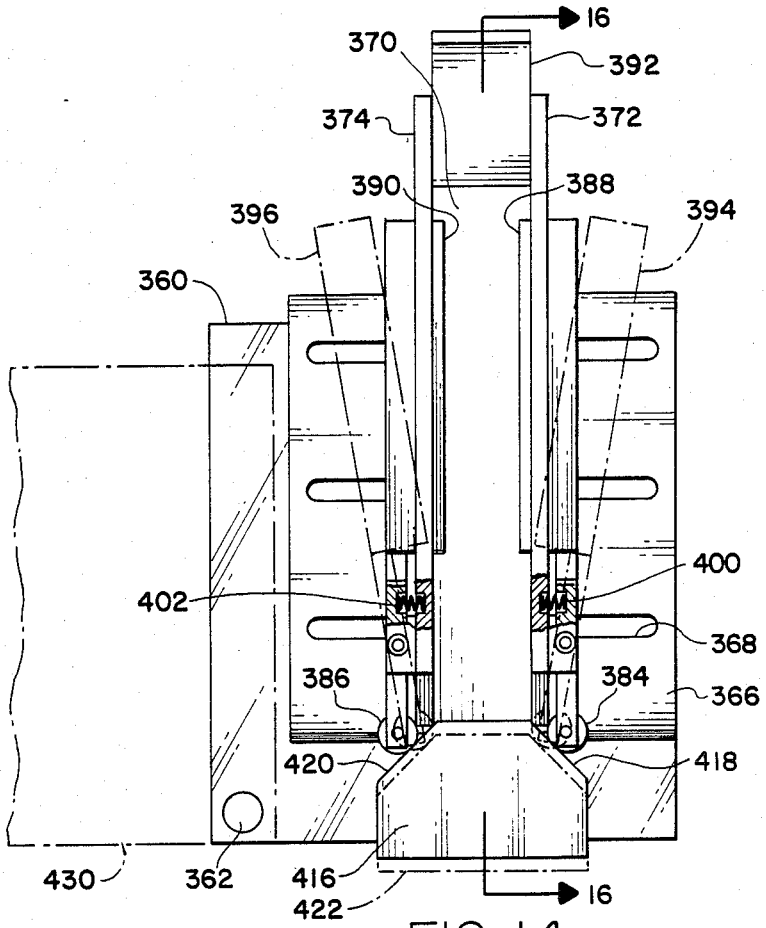
FIG. 14 is a plan view of a portion of the stacker mechanism of FIG. 13 and illustrates the movement of two support rails.
Figure 15:
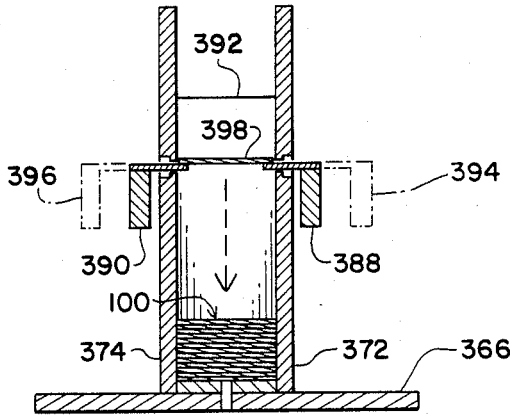
FIG. 15 is a sectional view of a portion of the stacker mechanism of FIG. 14 and is viewed along the section line marked (FIG. 15) in FIG. 16.

The support rails 376 and 378 are moveable from a closed position as shown in solid lines in FIG. 14 to an open position as shown in dashed lines at 394 and 396. When the support rails are at the closed position, they are operable for supporting a downset lead frame strip thereon as shown in FIG. 13 in dashed lines at 398. When the support rails open, the lead frame strip falls onto the top of the output stack 100. The support rails are biased toward the open position by springs 400 and 402 that are located between the rails and the stacker side plates 372 and 374.

The function of the stacker actuator 358 is to cause the support rails 376 and 378 to open during each downstroke of the punch press cycle. Stacker actuation lever 108 is pivotably attached to the bolster 56 by pivot 404. Cam bar 106 is fixedly attached to the punch holder 62 and has an inclined surface 406. Surface 406 contacts roller 408 on the upper end of lever 108 and causes the lever to pivot to the right during the downstroke of the punch press cycle. A cross lever 410 is disposed horizontally from a pivot point 412 on the bolster to a coupling 414 where it is joined to lever 108. A cam plate 416 is coupled to the center of the cross lever and has two surfaces 418 and 420 that contact rollers 384 and 386. When the punch holder lowers during the closing of the die set, cam bar 106 causes levers 108 and 410 to pivot which causes the cam plate 416 to retract. The retracted position of the cam plate is shown in dashed lines at 422 in FIG. 14. When the cam plate retracts, the spring biased support rails move to the open position. On the upstroke of the punch press cycle, spring 424 moves the cam plate back to its original position, causing the support rails to close.

Figure 16:
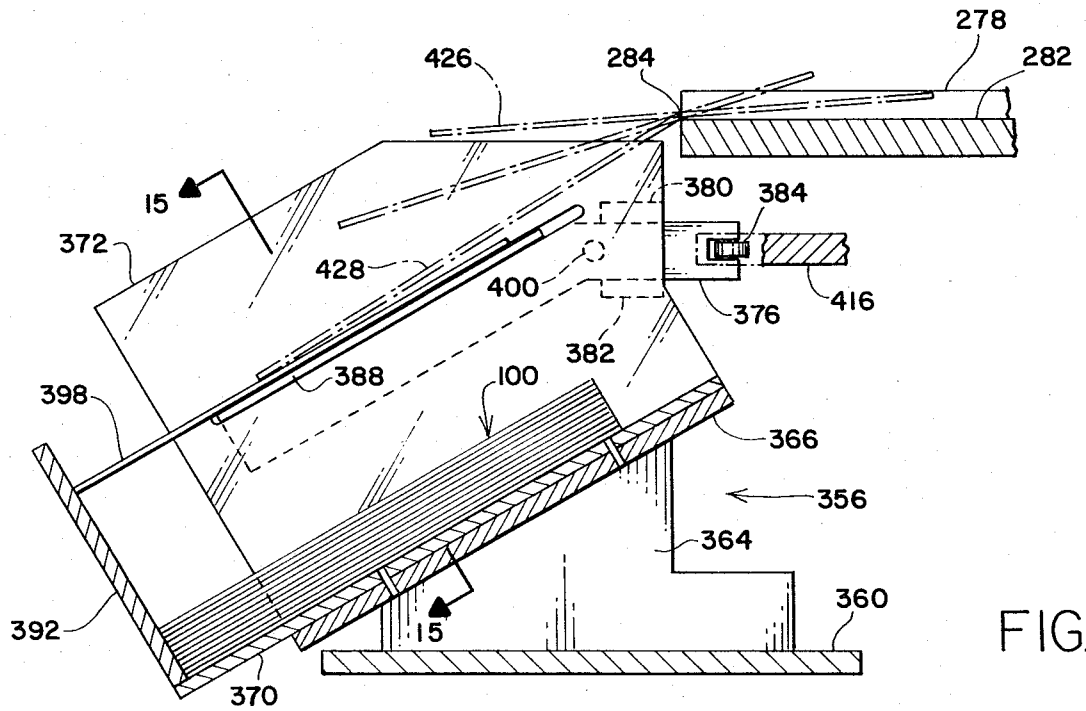
FIG. 16 is a front elevation sectional view of a portion of the stacker mechanism of FIG. 14 and is viewed along the section line marked (FIG. 16) in FIG. 14.

In FIG. 16, the unloading and stacking operations are illustrated. As the ejector pawl 320 pushes a downset lead frame strip 426 off the end of the die, it pivots about edge 284. As the pawl continues to push the lead frame strip off the edge, it rotates until it contacts the inclined support rails 388 and 398 as shown at 428. The lead frame strip slides down the rails until it contacts the backing plate 392. During the next downstroke of the ram cycle, the rails open and allow the lead frame strip to fall on top of the output stack 100. A two step stacking operation of first orienting and then dropping the lead frame strip as utilized by the stacking mechanism 52 of the present invention is advantageous because jams are prevented.

To unload the output stack 100 from the stacking mechanism, the stacker may be rotated to the position shown at 430 in FIG. 14. This automatically opens the support rails to allow ready access to the output stack. To change the stacking mechanism to accommodate a lead frame strip of a different width, the spacing plate is removed and replaced by another.

From the above description, it will be apparent that the invention disclosed herein provides a novel and advantageous automatic downset apparatus. As will be understood by those familiar with the art, the invention may be embodied in other specific forms without departing from the spirit or essential characteristics thereof.

I claim:

1. An automatic apparatus for loading objects into a die set prior to a forming operation and for unloading said objects from said die set subsequent to said forming operation, where said forming operation includes sequential steps of closing and opening said die set by a punch press and said die set includes a fixed die portion and a moveable punch portion, said apparatus comprising:

a support base to support said die set and said punch press;

guide rails means attached directly to said fixed portion for guiding said objects into said die set;

placing means attached directly to said moveable punch portion for placing one of said objects onto said guide rail means;

advancing means for transferring said one of said objects along said guide rail means into said die set;

positioning means for positioning said one of said objects within said die set; and unloading means coupled to said advancing means for transferring said one of said objects out of said die set.

2. An apparatus as in claim 1 wherein the placing means places a first object onto the guide rail means concurrently with the forming operation being performed on a second object positioned within the die set.

3. An apparatus as in claim 2 wherein the advancing means and the unloading means operate concurrently to simultaneously transfer the first object into the die set and transfer the second object out of said die set.

4. An apparatus as in claim 3 wherein the objects are lead frame strips having an overall shape that is generally rectangular and planar and the forming operation is operable for downsetting the die pads of a lead frame strip positioned within the die set.

5. An apparatus as in claim 4 wherein:

the guide rail means includes two guide rails each pivotably attached at one end thereof to the fixed die portion and moveable between a first rail position wherein said guide rails are substantially parallel and spaced apart by a distance equal to the width of the lead frame strip and a second rail position wherein the other of said ends of said guide rails are spread apart;

the placing means includes a rail opening mechanism coupled to the moveable punch portion and to said guide rails for moving said guide rails between said first and second rail positions, input stack positioning means for holding and positioning an input stack of said lead frame strips to be placed onto said guide rails, and vacuum pick-up means coupled to said moveable punch portion for transferring the uppermost lead frame strip from said input stack to said guide rails; and said rail opening mechanism is operable for moving said guide rails to said second rail position and said vacuum pick-up means into contact with said uppermost lead frame strip during the step of closing the die set, and wherein said rail opening mechanism is also operable for moving said guide rails back to said first rail position and said uppermost lead frame strip onto said guide rail during the step of opening said die set.

6. An apparatus as in claim 5 wherein the rail opening mechanism comprises:

rail means pivotably mounted to the support base and to the guide rails for moving said guide rails between the first and second rail positions; and an actuator body coupled to the moveable punch portion of the die set and disposed to rotate said rail cam means and move said guide rails to the second rail position during the step of closing said die set and to rotate said rail cam means and move said guide rails back to the first rail position during the step of opening said die set.

7. An apparatus as in claim 6 wherein the rail cam means comprises:

two cam base plates each pivotably mounted on the support base and coupled to the actuator body by slots which cause said cam base plates to rotate in opposite directions as said actuator body lowers and raises during the forming operation; and two rail plates each removeably affixed to one of said cam base plates and coupled to one of the guide rails, said rail plates are replaceable by other rail plates to change the spacing between said guide rails.

8. An apparatus as in claim 5 wherein the input stack positioning means comprises:

a shelf slideably coupled to said support base and disposed for movement between a load position for manually loading lead frame strips into said input stack positioning means and a feed position for positioning the input stack of said lead frame strips for placing onto the guide rails;

stack alignment means disposed on said shelf for aligning said lead frame strips into a uniform and vertical stack; and stack elevation means disposed on said shelf for raising the uppermost lead frame strip in said input stack to a predetermined height.

9. An apparatus as in claim 8 wherein the stack alignment means comprises:

a front frame locator bar affixed to said shelf and disposed proximate the forward end of the input stack of lead frame strips;

a rear frame locator pin adjustably affixed to said shelf and disposed proximate the aft end of said input stack; and a plurality of side frame locator pins adjustable affixed to said shelf and disposed proximate the sides of said input stack.

10. An apparatus as in claim 9 wherein the side frame locator pins are spring biased toward the input stack of lead frame strips.

11. An apparatus as in claim 8 wherein the stack elevation means comprises:

a stack support plate horizontally disposed and vertically guided for vertical travel with respect to the shelf;

a screw shaft disposed between said stack support plate and said shelf and operable for raising and lowering said stack support plate;

first motor and gear means disposed on said shelf and coupled to said screw shaft for raising and lowering said screw shaft; and sensor means coupled to said first motor and gear means for detecting the height of the uppermost lead frame strip and for signaling said first motor and gear means to raise the stack support plate when the uppermost lead frame strip is too low.

12. An apparatus as in claim 5 wherein the vacuum pick-up means comprises:

means for receiving vacuum; and a vacuum platen coupled to and moveable with the moveable punch portion of the die set and coupled to said means for receiving vacuum, said vacuum platen includes vacuum passages therein and disposed proximate the solid portions of the lead frame strip, said vacuum platen is disposed above the guide rails and is operable for passing between said guide rails and contacting the uppermost lead frame strip in the input stack during the step of closing said die set and for lifting said uppermost lead frame strip onto said guide rails during the step of opening said die set.

13. An apparatus as in claim 12 wherein the vacuum platen includes grooves on the underside thereof and the guide rails include rakes that are horizontally disposed flat members and that project inwardly into the space between said guide rails, said rakes are operable for entering said grooves and stripping the lead frame strip from said vacuum platen upon the movement of said guide rails from the second to the first rail position during the step of opening the die set.

14. An apparatus as in claim 12 wherein the vacuum platen is slideably coupled to the moveable portion of the die set and wherein the travel of the vacuum platen is less than the travel of said moveable portion.

15. An apparatus as in claim 5 further comprising a slide mechanism, and wherein said slide mechanism comprises:

at least one slide shaft affixed to the support base and disposed in substantially parallel alignment with the guide rails;

a slide that is slideably coupled to said slide shaft; and reciprocating crank means coupled to said slide and operable for moving said slide along said slide shaft from a home position to a forward position and then back to said home position.

16. An apparatus as in claim 15 wherein the reciprocating crank means comprises:

a crank pivot affixed to the support base and operable for rotation;

a crank lever pivotably coupled to the slide and slideably coupled to said crank pivot;

a crank arm pivotably coupled to said support base and slideably coupled to said crank lever and operable for pivoting said crank lever and moving said slide between the home positon and the forward position; and second motor and gear means coupled to said crank arm and said support base for rotating said crank arm.

17. An apparatus as in claim 16 wherein said second motor and gear means includes a one-shot clutch that is operable for rotating the crank arm one revolution thereby moving the slide from the home position to the forward position and then back to the home position.

18. An apparatus as in claim 15 wherein the advancing means comprises:

a pusher coupled to the slide and disposed between the guide rails, said pusher is operable for pushing a lead frame strip along said guide rails and into the die set as the slide moves from the home position to the forward position; and a spring disposed between said pusher and said slide for biasing said pusher toward said lead frame strip.

19. An apparatus as in claim 18 wherein the positioning means comprises:

a slot in the fixed die portion of the die set, said slot disposed horizontally and open in the direction toward the pusher and extending a predetermined length into said fixed die portion, said slot is positioned such that said pusher contacts the end of said slot when the lead frame strip is sufficiently advanced into said die set;

a stop disposed in said fixed die portion at a distance forward of said end of said slot that is substantially equal to the length of said lead frame strip, said stop is operable for halting the forward motion of said lead frame strip and is moveable between a raised position and a lowered position, whereby said lead frame strip is properly positioned within said die set when it is located between said stop and said end of said slot;

stop depression means for lowering said stop to said lowered position during the forming operation to permit the unloading of said lead frame strip; and stop release means for raising said stop to said raised position after said unloading of said lead frame strip to allow said stop to halt the forward motion of the subsequently loaded lead frame strip.

20. An apparatus as in claim 19 wherein the positioning means further comprises:

a stop actuator bar coupled to the fixed die portion of the die set, said stop actuator bar is operable for movement between a first and a second stop actuator position and has a notch disposed proximate the stop which locks said stop actuator bar in said second stop actuator position when said stop is in its raised position;

actuator biasing means disposed between said stop actuator bar and said fixed die portion for biasing said stop actuator bar toward said first stop actuator position;

stop biasing means disposed between said stop and said fixed die portion for biasing said stop toward said raised position;

and wherein the stop depression means comprises a stop depression pin affixed to the moveable punch portion of said die set and is operable for moving said stop to its lowered position during the step of closing said die set, whereupon said stop actuator bar moves to said first stop actuator position and locks said stop in said lowered position;

and wherein the stop release means comprises a stop actuator cam that is affixed to and moveable with the slide and is operable for moving said stop actuator bar to said second stop actuator position and permitting said stop to raise to said raised position.

21. An apparatus as in claim 15 wherein said unloading means comprises:

ejector means coupled to said slide for pushing a lead frame strip out of the fixed die portion of the die set after the forming operation has been performed;

a stacker coupled to said support base and operable for receiving said lead frame strip as it is pushed out of said die set by said ejector means, said stacker is also operable for positioning said lead frame strip above an output stack of lead frame strips and then dropping said lead frame strip onto the top of said output stack; and stacker actuator means coupled to the moveable punch portion of said die set and said stacker and operable for causing said stacker to drop said lead frame strip onto the top of said output stack during the step of closing said die set.

22. An apparatus as in claim 21 wherein said ejector means comprises:

an ejector bar affixed to and moveable with said slide from the home position to the forward position and disposed substantially parallel to said guide rails;

ejector bar support means for supporting said ejector bar;

an ejector arm base affixed to and moveable with said ejector bar;

an ejector arm rotateably coupled at one end thereof to said ejector arm base and with the other end thereof extending to the region between the fixed die portion and the moveable punch portion of the die set; and an ejector pawl affixed the said other end of said ejector arm and disposed to push a lead frame strip from said die set when said slide moves from said home position to said forward position, said ejector pawl moveable between a lowered pawl position for contacting said lead frame strip during slide movement from said home position to said forward position and a raised pawl position for clearance above said lead frame strip during slide movement from said forward position to said home position.

23. An apparatus as in claim 22 wherein said ejector bar support means comprises:

a forward bar support affixed to the support base with bearing means to permit the ejector bar to slide therethrough; and a rear bar support affixed to said support base with bearing means to permit the ejector bar to slide therethrough;

and wherein said ejector means further comprises a forward arm actuator affixed to said forward bar support and operable for rotating the ejector arm to move the ejector pawl to the raised pawl position when the slide reaches the forward position, and also comprises a rear arm actuator affixed to said rear bar support and operable for rotating the ejector arm to move the ejector pawl to the lowered pawl position when the slide reaches the home position.

24. An apparatus as in claim 21 wherein the stacker comprises:

two stacker side plates disposed vertically and spaced apart by a distance that is substantially equal to the width of the lead frame strip;

a stacker base coupled to the support base for supporting said stacker side plates at a position proximate the portion of the die set where said lead frame strip exits the die set after the forming operation;

two support rails, each of said support rails pivotably coupled to one of said stacker side plates, said support rails each having a support end and a cam following end disposed on opposite sides of the pivotable coupling, said support rails are moveable between a closed position where said support ends are pivoted together for supporting said lead frame strip and an open position where said support ends are pivoted apart for allowing said lead frame strip to drop on the top of the output stack, said cam following ends are in contact with the stacker actuator means for selection of said open or closed positions; and biasing means for biasing said support rails toward said open position.

25. An apparatus as in claim 24 wherein the stacker actuator means comprises:

a cam plate slidably coupled to said support base and operable for movement between an extended position and a retracted position, said cam plate is in contact with the cam following ends of the support rails of the stacker and cooperates with said cam following ends to position the support rails at the closed position when said cam plate is at said extended position and to position the support rails at the open position when said cam plate is at said retracted position;

lever means pivotable coupled to said support base and coupled to said cam plate for moving said cam plate between said extended and retracted positions; and a cam bar affixed to the moveable punch portion of the die set and operable for contacting said lever means during the step of closing said die set for moving said cam plate to said retracted position.

26. An apparatus as in claim 1 wherein:

the guide rail means includes two guide rails each pivotably attached at one end thereof to the fixed die portion and moveable between a first rail position wherein said guide rails are substantially parallel and spaced apart by a distance equal to the width of the object to be loaded and a second rail position wherein the other of said ends of said guide rails are spread apart;

the placing means includes a rail opening mechanism attached to the moveable punch portion and to said guide rails for moving said guide rails between said first and second rail positions, input stack positioning means for holding and positioning an input stack of said objects to be loaded to be placed onto said guide rails, and pick-up means coupled to said moveable punch portion for transferring the uppermost object to be loaded from said input stack to said guide rails; and said rail opening mechanism is operable for moving said guide rails to said second rail position and said pick-up means into contact with said uppermost object to be loaded during the step of closing the die set, and wherein said rail opening mechanism is also operable for moving said guide rails back to said first rail position and said uppermost object to be loaded onto said guide rail during the step of opening said die set.

27. An apparatus as in claim 26 wherein the placing means places a first object onto the guide rail means concurrently with the forming operation being performed on a second object positioned within the die set.

28. An apparatus as in claim 26 wherein the advancing means and the unloading means operate concurrently to simultaneously transfer the first object into the die set and transfer the second object out of said die set.

29. An apparatus as in claim 26 wherein the objects are lead frame strips having an overall shape that is generally rectangular and planar and the forming operation is operable for downsetting the die pads of a lead frame strip positioned within the die set.

30. A method for automatically downsetting lead frame strips in a die set having a stationary die and a moveble punch, said method comprising the steps of:

manually placing an input stack of lead frame strips to be downset into an input stack positioning mechanism;

spreading the guide rails apart as the die set is closed;

lowering a vacuum platen through the spread-apart guide rails and onto the top of the input stack as said die set is closed;

grasping the uppermost lead frame strip by vacuum force applied through said vacuum platen;

raising said vacuum platen and said lead frame strip as said die set is opened;

stripping said lead frame strip from said vacuum platen by rakes affixed to said guide rails and closing said guide rails as the die set is opened;

advancing said lead frame strip along said guide rails and into said die set until the forward edge of said lead frame strip contacts a stop within said die set;

downsetting the die pads of said lead frame strip by closing and then opening said die set;

unloading said lead frame strip from said die set in the same direction as said step of advancing said lead frame strip into said die set; and stacking said lead frame strip onto an output stack.

31. The method according to claim 30 wherein the step of loading acts upon a first lead frame strip, the step of downsetting acts upon a second lead frame strip, and the step of stacking acts upon a third lead frame strip, and wherein said steps of loading, downsetting, and stacking corresponding lead frame strips occur simultaneously.

32. The method according to claim 30 wherein the step of advancing acts upon the first least frame strip and the step of unloading acts upon the second lead frame strip, and wherein said steps of advancing and unloading corresponding lead frame strips occur simultaneously and subsequent to the simultaneous steps of loading, downsetting, and stacking.

33. The method according to claim 32 wherein the step of downsetting additionally comprises the step of lowering the stop below the level of the lead frame strip.

34. The method according to claim 33 wherein the step of unloading the lead frame strip from the die set additionally comprises the step of raising the stop after said lead frame strip has passed said stop so as to prepare for positioning the lead frame strip that will be subsequently loaded in said die set.

35. The method according to claim 32 wherein the step of stacking the lead frame strip onto an output stack comprises the steps of:

positioning said lead frame strip as it exits the die set on top of two support rails disposed above the top of said output stack; and dropping said lead frame strip onto the top of said output stack by withdrawing said support rails.

36. The method according to claim 30 wherein said input stack positioning mechanism is operable for positioning the top of the stack of lead frame strips to be downset at a uniform height.

37. The method according to claim 30 wherein the steps of advancing and unloading the lead frame strip into the die set is performed by a slide mechanism, and wherein said step of advancing said lead frame strip is performed by a pusher slidably coupled to said slide mechanism and disposed between the guide rails for pushing said lead frame strip into said die set until said pusher bottoms out in a slot in said stationary die.

* * * * *